United States Patent [19]

Barbour

[11] Patent Number: 4,480,573

[45] Date of Patent: Nov. 6, 1984

[54] RAIL MOUNT ANCHOR BRACKET

[76] Inventor: Robert G. Barbour, P.O. Box 25876, West Los Angeles, Calif. 90025

[21] Appl. No.: 466,115

[22] Filed: Feb. 14, 1983

[51] Int. Cl.[3] ..... B63B 21/22

[52] U.S. Cl. ..... 114/210; 114/343; 114/364

[58] Field of Search ..... 224/30 A, 36, 41; 114/210, 343, 364, 221 R; 248/214, 215, 230, 298, 316.91, 316.6

[56] References Cited

U.S. PATENT DOCUMENTS

| | | | |
|---|---|---|---|
| 2,010,479 | 8/1935 | Dennis | 224/41 |
| 2,709,494 | 5/1955 | Luce | 248/316.91 |
| 3,752,107 | 8/1973 | Tuyl | 114/210 |
| 3,991,699 | 11/1976 | Bass | 248/214 |

*Primary Examiner*—Sherman D. Basinger

*Attorney, Agent, or Firm*—Poms, Smith, Lande & Rose

[57] ABSTRACT

A mount for securing Danforth-type anchors to horizontally extending railings includes a generally L-shaped bracket. A pair of retaining loops may be mounted to hold one arm of the bracket on either the top or the bottom of the railing to provide limited vertical adjustability in height for the anchor mount. A pair of Danforth-type anchor crown plate retaining and stop members are fastened into slots in the other arm of the L-shaped bracket. By adjusting the separation between the retaining members, different size Danforth-type anchors may be accommodated; and by turning the bracket upside down on the railing, and/or by reversing the location of the stop members, the mounting position for the anchor may be varied several inches in height, inboard or outboard of the rail.

17 Claims, 11 Drawing Figures

RAIL MOUNT ANCHOR BRACKET

FIELD OF THE INVENTION

This invention relates to brackets for the mounting of anchors on the bow or stern pulpit or the rail of a boat.

BACKGROUND OF THE INVENTION

Danforth-type anchors are relatively awkward and inconvenient to stow on board a small ship, because their configuration is irregular and potentially damaging to the boat and injurious to persons who may be in close proximity to the anchor. A Danforth-type anchor characteristically includes a main shank to which the anchor rope or chain is secured, a pair of flukes which are broad, triangular and pointed, and intended to stick into the bottom of the ocean, a pair of crown plates secured to the flukes, and a stock or bar (of different diameters depending on the size of the anchor) which extends transversely between the two crown plates and may serve as a pivot member for the rotation of the flukes and crown plates relative to the main shank of the anchor, as well as preventing the anchor from rolling over and dislodging the flukes from the ocean bottom. One prior patent showing a Danforth-type anchor is J. M. Wood, Jr. U.S. Pat. No. 3,291,093.

Various brackets have been proposed heretofore for mounting Danforth-type anchors. One such arrangement for mounting on the rail or pulpit is shown in U.S. Pat. No. 3,935,830. The arrangements shown in this patent include two widely spaced brackets which engage the transverse stock of the Danforth-type anchor; and this engagement is snug on only one size anchor, with smaller anchors being free to rattle. Also, this type of anchor will locate the anchor dangling directly below the rail in a space normally occupied by collapsed sails, spinnaker turtles or the like. The individual brackets, when not in use, are somewhat unsightly, and protrude in what may be a somewhat inconvenient manner. U.S. Pat. No. 3,752,107 discloses a bracket for holding Danforth-type anchors by one of the crown plates, limited to a vertical stanchion for a boat's railing, with points sticking upward in a dangerous manner. The device as shown in the latter patent is also lacking in full adjustability, and is somewhat complex.

An important object of the present invention is to provide a neat, good-looking, and versatile anchor bracket for mounting Danforth-type anchors of different sizes in virtually any desired position relative to the pulpit or any horizontal railing of a boat.

SUMMARY OF THE INVENTION

In accordance with the present invention, an anchor bracket is formed of a support member including two portions with at least one gripper clip loop mounted on one of these portions and retaining and stop members mounted on the other portion of the support member to hold one of the crown plates of a Danforth-type anchor. Preferably, the support member is an L-shaped angle bracket, with a pair of gripper loops on one arm thereof, and the retaining and stop members on the other end thereof.

In accordance with additional features of the invention, the gripper loops may be secured to either side of the bracket so that either side of the angled bracket may be placed in engagement with the railing, thereby raising or lowering the height of the bracket by a small amount; the retaining and stop means may be mounted in slots on the other arm of the angled bracket to accommodate different size crown plates; and the retaining and stop members may also be reversed, so that the stop portions are always toward the deck, whereby when the bracket is reversed to substantially raise the mounting position for the crown plate, the stops are still effective.

The gripper loops may be U-shaped and have the appearance of curved or bent bolts threaded at each end to accommodate mounting to railings which are curved. The entire assembly may be made of stainless steel or other durable materials such as sheet metal stock, or bent or formed sheet metal stock so as to resist marine corrosion; and the gripper clip loops may have suitable transverse dimensions across between the two legs of their U-shaped configuration and appropriate length to accommodate either one inch or seven-eighths inch outer diameter railing.

A particular advantage of the present invention is that it encourages boaters to have their anchor ready for emergency deployment.

Other objects, features, and advantages of the invention will become apparent from a consideration of the following detailed description and from the accompanying drawings.

DETAILED DESCRIPTION

Figure 1:
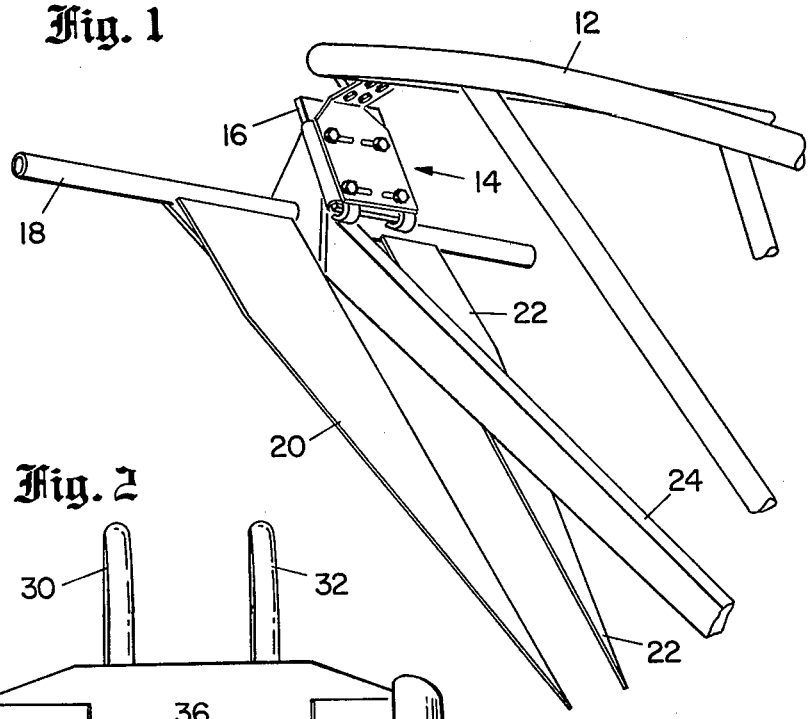
FIG. 1 shows an anchor bracket illustrating the principles of the invention, with the crown plate of a Danforth-type anchor mounted in it, and with the bracket secured to a pulpit railing.

Referring more particularly to the drawings, FIG. 1 shows a railing or pulpit 12 to which an anchor mount bracket 14, illustrating the principles of the invention, is secured. One of the crown plates 16 of the Danforth-type anchor is mounted in the bracket 14. For completeness it may be noted that the Danforth-type anchor also includes a stock 18, a pair of flukes 20 and 22, and a main shank 24 pivotally mounted at one end to the stock between crown plates and the flukes, and being secured to an anchor chain or cable at its other end.

Figure 2:
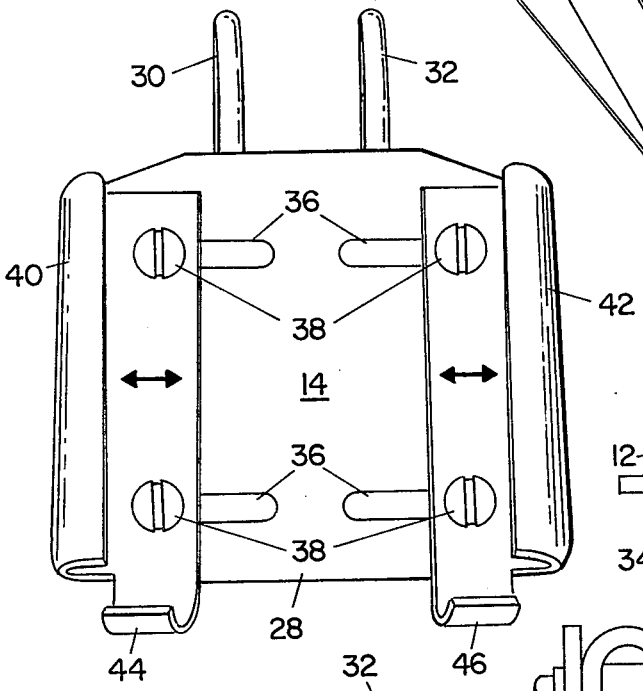
FIG. 2 is a front view of the bracket illustrating the principles of the invention.
Figure 3:
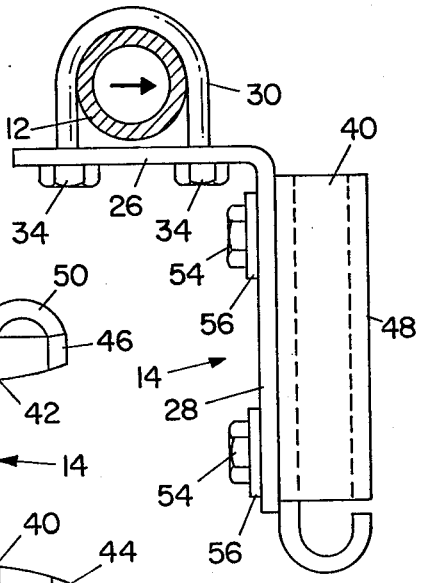
FIG. 3 is a side view of the bracket.
Figure 4:
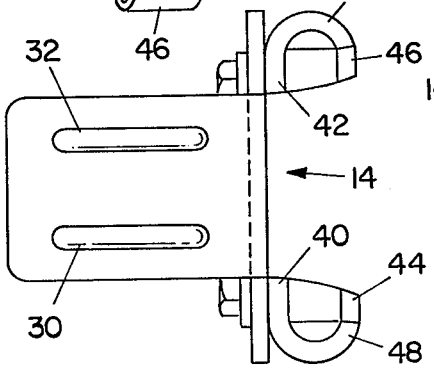
FIG. 4 is a top view of the bracket from the side where the gripper loops are mounted.

The configuration of the rail mount anchor bracket 14 illustrating the principles of the present invention will now be considered by reference to FIGS. 2, 3 and 4. As best seen in FIGS. 3 and 4, the bracket 14 is essentially an angle bracket made preferably of stainless steel, and having a first arm 26 and a second arm 28. The arm 26 is provided with four holes through which the gripper clip loops 30 and 32 are secured. The ends of the gripper clip loops 30 and 32 are threaded to receive nuts such as those shown at 34 in FIG. 3. These nuts are provided with supplemental frictional securing arrangements of any of the known types, so that lock washers are not necessary to prevent the nuts from coming free under vibration conditions or the like. The loops 30 and 32 may have a space between their legs of approximately one inch or slightly more than an inch and have sufficient length so that they may be secured to either one inch outer diameter railings or to $\frac{7}{8}''$ railings, the two sizes most commonly found in small boats. Of course, other sizes could be accommodated by special design.

In FIG. 3, and in the showings of FIGS. 5 through 11 to be discussed below, some space is shown between the rail 12 and bracket 26, and this would of course be eliminated as the nuts 34 are tightened. In addition arrows are included within each showing of rail 12 in these figures to indicate the outboard side of the rail, and to emphasize the eight different basic locations or mounting positions for the bracket 14 relative to the rail 12.

The other arm 28 of the angle bracket is provided with four slots 36 through which the fasteners 38 are mounted. The fasteners 38 are flat head screws mounted in countersunk holes to allow free mounting and removal of the crown plate. Adjustable members 40 and 42 are provided to hold or retain the two side edges of the crown plate 16 of the Danforth-type anchor; and at the lower extremity of the members 40 and 42 are stop portions 44 and 46, respectively, which prevent the crown plate from slipping on through the brackets. These stop members 44 and 46 are tapered away from the center of the bracket to allow the shank to fit between them, when the members 40 and 42 are close together to accommodate smaller anchors. The outer edges 48 and 50 of members 40 and 42, respectively, are inturned to grip the outer edges of the crown plate 16. The fasteners 38 are held in place by the nuts 54 which engage the inside of the arm 28 of the bracket 14 through the optional washers 56. As in the case of the nuts 34, the nuts 54 may include frictional portions so that additional locking washers are not required.

Figure 5:
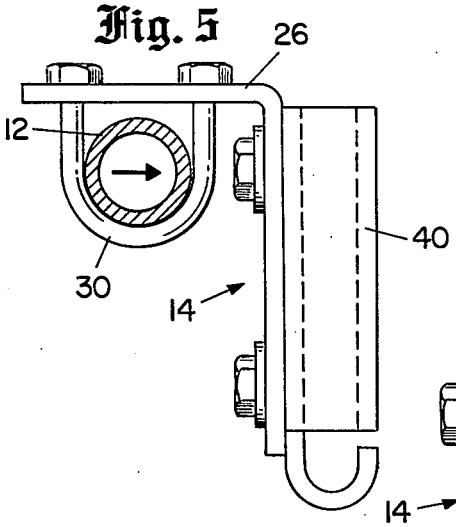
FIGS. 5 through 11 show alternative mounting configurations to shift the mounting position higher or lower, or inboard or outboard, with respect to the railing.
Figure 7:
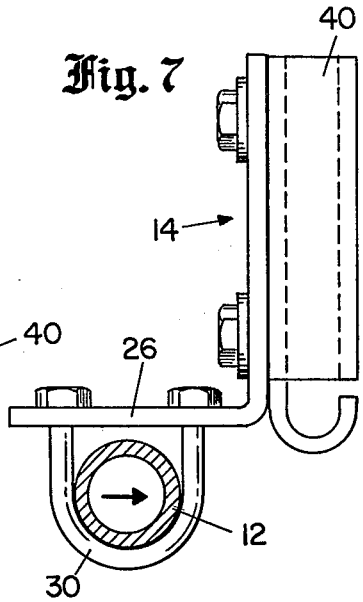
Figure 6:
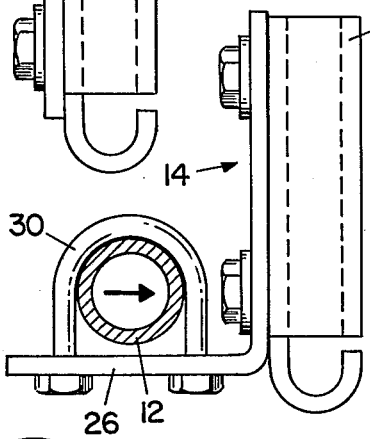
Figure 10:
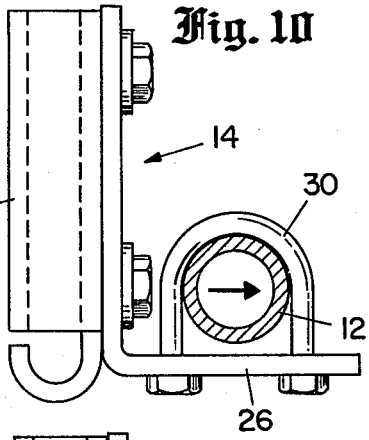
Figure 8:
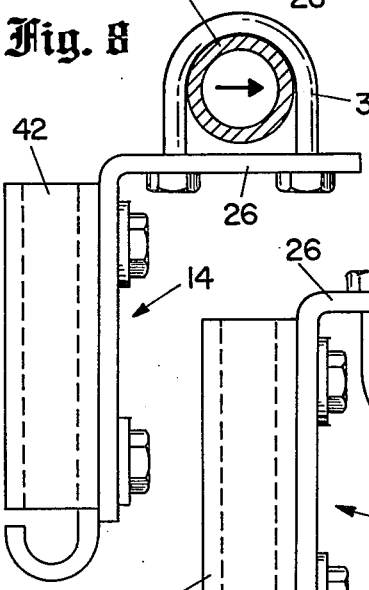
Figure 9:
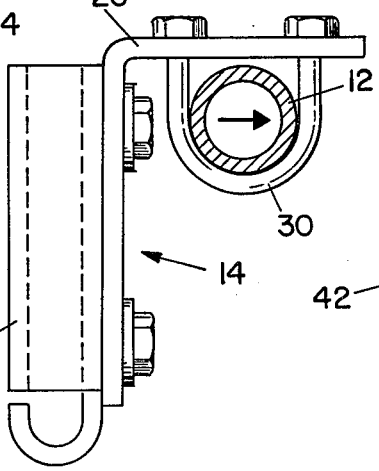
Figure 11:
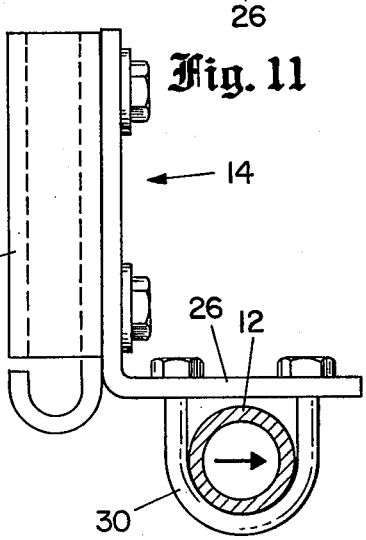

In the mounting arrangement of FIG. 3, the bracket arm 26 would be below the railing 12 which would be secured by the loops 30 and 32. In FIG. 5, however, the position of the gripper clip loops 30 and 32 has been reversed, so that the railing is now intended to be mounted below the arm 26. This has the effect of raising the position of the crown plate, and indicates the versatility which is provided by the present anchor bracket. This versatility may be necessary for the anchor to clear furling drums, headstay fittings, windlasses, or other deck hardware.

FIGS. 6 through 11 are included to show various other alternative positions for the anchor bracket. In connection with FIGS. 3 and 5 through 11 it is again noted that the arrow within rail 12 indicates the outboard side of the rail, and in each case the bolts would be tightened up to hold the bracket firmly in the desired position. Now, returning to FIGS. 6 through 11, in FIG. 11, the bracket is arranged so that the mounting position for the crown plate would be inboard of the railing, and the lower edge of the crown plate would be about even with the top of the railing. This is in contrast to the arrangement of FIG. 5, where the crown plate would be mounted outboard of the railing and wherein it is also mounted with the lower edge of the crown plate substantially below the railing.

Accordingly, from the showings of FIGS. 1 through 11, the bracket of the present invention is clearly very versatile and flexible in that it may not only accommodate different size Danforth-type anchors, but may be arranged to mount these anchors at nearly any position or angle relative to the railing which might be desired by the boat owner. It is further noted that FIGS. 3 and 5 through 11 show the bracket 14 with its two arms 26 and 28 extending horizontally and vertically, respectively, to illustrate the eight different basic locations, in practice, however, the bracket would normally be tilted somewhat to position the anchor precisely as desired by the boat owner, as shown in FIG. 1.

In conclusion, it is to be understood that the particular embodiment shown in the drawings and discussed hereinabove is merely illustrative of the principles of the invention. Other alternatives could be devised by those skilled in the art without departing from the principles of the present invention. Thus, by way of example and not of limitation, instead of being at precisely right angles relative to one another, the two arms of the angle bracket could be at a different orientation. Also, instead of being bolt-like loops, the gripper loops 30 could have other configurations. Accordingly, the present invention is not limited to that precisely as shown and described herein.

What is claimed is:

1. A bracket assembly for the adjustable mounting of different size Danforth-type anchors at desired positions relative to a supporting rail, comprising:

an angle bracket including first and second arms;

gripper clip loop means for holding either side of said first arm of said bracket to a supporting rail;

the second arm of said bracket being provided with slots extending substantially parallel to the intended axis of the rail to which the bracket is to be secured; and first and second retaining and stop means for holding a crown plate of a Danforth-type anchor, said first and second means being mounted on said slots for adjustment toward and away from one-another to hold the crown plate of different size Danforth-type anchors, said first and second retaining and stop means being reversible so that the stop portions thereof may be located either toward or away from the junction between the two arms of said bracket;

whereby said bracket may be positioned to hold different size Danforth-type anchors in at least eight different positions relative to the rail.

2. A bracket assembly as defined in claim 1 wherein said gripper clip loop means includes a pair of substantially U-shaped curved bolts, whereby the bracket assembly may be readily secured to a curved railing.

3. A bracket assembly as defined in claim 1 wherein said bracket assembly is formed of stainless steel or other non-corroding metal alloy.

4. A bracket assembly as defined in claim 1 wherein said gripper clip loop means and said retaining and stop means are both held in place relative to said assembly by threaded fasteners including integral frictional means for avoiding loosening of said fasteners.

5. A bracket assembly as defined in claim 1 wherein said angle bracket is made of sheet metal stock.

6. A bracket assembly as defined in claim 1 wherein said first and second arms of said angle bracket are oriented substantially perpendicular to one-another.

7. A bracket assembly as defined in claim 1 wherein said retaining and stop means are made of bent or formed sheet metal stock.

8. A bracket assembly for the adjustable mounting of different size Danforth-type anchors at desired positions relative to a supporting rail, comprising:

a main support member including first and second portions;

gripper clip loop means for holding either side of said first portion of said main support member to a rail;

the second portion of said main support member being provided with slots extending substantially parallel to the intended axis of the rail to which the bracket assembly is to be secured; and first and second retaining and stop means for holding a crown plate of a Danforth-type anchor, said first and second means being mounted on said slots for adjustment toward and away from one-another to hold the crown plate of different size Danforth-type anchors, said first and second retaining and stop means being reversible so that the stop portions thereof may be located either toward or away from the junction between the two arms of said bracket, each of said retaining and stop means including means for preventing movement in one lateral direction and means for preventing downward movement of a Danforth-type anchor;

whereby said bracket may be positioned to hold different size Danforth-type anchors in at least eight different positions relative to the rail.

9. A bracket assembly as defined in claim 8 wherein said gripper clip loop means includes a pair of substantially U-shaped curved bolts, whereby the bracket assembly may be readily secured to a curved railing .

10. A bracket assembly as defined in claim 8 wherein said bracket assembly is formed of stainless steel or other non-corroding metal alloy.

11. A bracket assembly as defined in claim 8 wherein said gripper clip loop means and said retaining and stop means are both held in place relative to said assembly by threaded fasteners including integral frictional means for avoiding loosening of said fasteners.

12. A bracket assembly as defined in claim 8 wherein said main support member is made of sheet metal stock.

13. A bracket assembly as defined in claim 8 wherein said first and second portions of said angle bracket are oriented substantially perpendicular to one another.

14. A bracket assembly as defined in claim 8 wherein said retaining and stop means are made of bent or formed sheet metal stock.

15. A bracket assembly for the adjustable mounting of different size Danforth-type anchors at desired positions relative to a supporting rail, comprising:

an angle bracket including first and second arms;

substantially U-shaped curved bolt means for holding either side of said first arm of said bracket to a supporting rail;

first and second retaining and stop means for holding a crown plate of a Danforth-type anchor, said first and second means being reversibly mounted on said second arm so that the stop portions thereof may be located either toward or away from the junction between the two arms of said bracket;

each of said retaining and stop means being formed of a flat sheet metal member having an inturned side for holding one side edge of the crown plate of a Danforth-type anchor, and having an inturned end for restraining downward movement of the edge of the crown plate located toward the shank, of a Danforth-type anchor; and means for mounting said first and second retaining and stop means adjustably spaced apart from one another to hold the crown plates of different size Danforth-type anchors.

16. A bracket assembly as defined in claim 15 wherein said angle bracket is made of sheet metal stock.

17. A bracket assembly as defined in claim 15 wherein said first and second arms of said angle bracket are oriented substantially perpendicular to one another.

* * * * *